US005435777A

United States Patent [19]

Takatani et al.

[11] Patent Number: 5,435,777

[45] Date of Patent: Jul. 25, 1995

[54] COIN PACKAGING APPARATUS

[75] Inventors: Ichiro Takatani; Yusuke Inuki; Yoshinobu Kobayashi; Masanori Taniguchi, all of Himeji, Japan

[73] Assignee: Glory Kogyo Kabushiki Kaisha, Hyogo, Japan

[21] Appl. No.: 987,592

[22] Filed: Dec. 9, 1992

[30] Foreign Application Priority Data

Dec. 10, 1991 [JP] Japan ..... 3-325943
Feb. 21, 1992 [JP] Japan ..... 4-035389

[51] Int. Cl.[6] ..... B65B 59/00
[52] U.S. Cl. ..... 453/31; 53/532
[58] Field of Search ..... 453/7, 11, 31, 56; 53/212, 254, 532

[56] References Cited

U.S. PATENT DOCUMENTS

| | | | |
|---|---|---|---|
| 4,058,954 | 11/1977 | Asami | 53/212 X |
| 4,060,093 | 11/1977 | Douno | 53/212 X |
| 4,098,056 | 7/1978 | Ozaki | 53/212 |
| 4,126,146 | 11/1978 | Ozaki | 453/56 X |
| 4,333,296 | 7/1982 | Watanabe | 53/212 X |
| 4,869,029 | 9/1989 | Takatani et al. | 453/31 X |
| 4,997,406 | 3/1991 | Horiguchi et al. | 453/7 X |
| 5,002,516 | 3/1991 | Watanabe et al. | 453/7 |

FOREIGN PATENT DOCUMENTS

| | | |
|---|---|---|
| 1408445 | 7/1988 | U.S.S.R. . |
| 91/08952 | 7/1991 | WIPO . |

*Primary Examiner*—F. J. Bartuska

*Attorney, Agent, or Firm*—Wenderoth, Lind & Ponack

[57] ABSTRACT

A coin packaging apparatus facilitates a change operation of the type of coins processed, can correspond to any type of coin, and is an apparatus which feeds coins one by one from a circular plate and conveys them along a coin passage and in which required processing, such as totaling and separation of the coins to be packaged, is performed. The coins are fed to a coin stacking portion where a required number of coins are stacked and packaged by a coin packaging portion. A coin passage width adjustment device steplessly adjusts the width of the coin passage, a coin passage height adjustment device steplessly adjusts the height of the coin passage, and a coin stacking portion inner diameter adjustment device steplessly adjusts the inner diameter of the coin stacking portion. A coin information input portion receives coin information, including at least the diameter and thickness of coins to be proposed. A coin information coin passage width information $P_1$ and the coin storage portion stores coin information of at least the diameter and thickness of coins to be processed in correspondence with the type of coin. A coin type specification portion specifies the type of coin to be processed, and a control unit determines the inner diameter of a coin stacking portion and the height and width of a coin passage portion from coin information from the coin information storage portion and on the basis of the coin type from the coin type specification means, and operates each of the adjustment portion to those determined dimensions.

5 Claims, 13 Drawing Sheets

| | | |
|---|---|---|
| COIN BLOCK 1 | RENEWAL DATE | 151 |
| | DIAMETER D (1) | 152 |
| | THICKNESS T (1) | 153 |
| | COIN PASSAGE WIDTH INF. P1 (1) | 154 |
| | COIN PASSAGE HEIGHT INF. P2 (1) | 155 |
| | COIN COLLECT PORTION INNER DIAMETER INF. P3 (1) | 156 |
| | COIN SUPPORT LOWERING PATTERN | 157 |
| | COIN TYPE SYMBOL K (1) | 158 |
| | COIN TYPE NUMERICAL VALUE H (1) | 159 |
| | PACKING UNIT NUMBER M (1) | 160 |
| | ⋮ | |
| COIN BLOCK 2 | RENEWAL DATE | |
| | DIAMETER D (2) | |
| | THICKNESS T (2) | |
| | COIN PASSAGE WIDTH INF. P1 (2) | |
| | COIN PASSAGE HEIGHT INF. P2 (2) | |
| | COIN COLLECT PORTION INNER DIAMETER INF. P3(2) | |
| | COIN SUPPORT LOWERING PATTERN | |

FIG. 15

COIN PACKAGING APPARATUS

BACKGROUND OF THE INVENTION

The present invention relates to coin packaging apparatus, and more particularly to coin packaging apparatus which automatically adjust the inner diameter of a coin stacking portion and the height and width of a coin passage and performs processing for the type and amount of coins.

A coin packaging apparatus which stacks a required number of coins and packages the stacked coins in a paper package has been disclosed in Japanese Patent Laid-Open Publication No. 121491-1974 for example.

The coin packaging apparatus disclosed in this publication feeds coins one by one from a circular plate and conveys them along a coin passage in which processing, such as totaling and stopping of the coins to be packaged, is performed for small-diameter coins, and the coins are then fed to a coin stacking portion provided at the end of the coin passage and are successively stacked. When a required number of coins has been stacked, those stacked coins are sent to a packaging portion and are packaged in paper packaging.

The coin passage and the coin stacking portion can be adjusted so that the height and width of the coin passage and the inner diameter of the stacking portion can be made to correspond to the type of currency, and thus enable processing of coins having different diameters and thicknesses. More specifically, of the members which configure the coin passage, the width of the coin passage has a multi-sided cam which comes into contact with a movable passage member which can move in the direction of the width of the coin passage, and manual turning of a coin type setting handle rotates this cam so that one of the cam surfaces is selected, and that cam surface moves the movable passage member to a position which corresponds to the diameter of the coins to be processed.

In addition, the coin passage comprises a thickness regulating member which regulates the coins fed from the circular plate to a single layer, and a conveyor belt which contacts the upper surface of the coins and conveys them, with both the thickness regulating member and the conveyor belt being supported in a movable frame which can move up and down, and the manual rotation of a height adjustment handle moves the entire frame up and down and adjusts the height of the coin passage.

Furthermore, the coin stacking portion is configured from a support portion which supports a lower surface of a peripheral portion of a coin, protruding into a belt surface of a pair of belts which are arranged so that their running surfaces oppose each other, and this pair of belts are respectively supported by parallel links so that they can be moved, and these parallel links can be moved by one multi-side cam which is linked to the coin type setting handle. This adjust the belt surface separation distance of the pair of belts so that it corresponds to the diameter of the coins to be processed, and adjusts the inner diameter of the stacker portion.

In addition, the coin packaging portion has three packaging rollers which sandwich the stacked coins by approaching the coins while rotating, and packaging paper is fed between the rollers and the stacked coins and is wound around the stacked coins and the top and bottom ends of the packaging paper are bent inwards by a folding head.

However, with such a conventional coin packaging apparatus, it is necessary to manually turn the coin type setting handle in accordance with the type of coin to be processed and therefore adjust the inner diameter of the coin stacking portion and the width of the coin packaging portion, and it is also necessary to manually rotate the height adjustment knob in order to adjust the height of the coin passage, and so there is the problem that many operations are required when there is to be a change in the type of coins which are being processed.

In addition, the cam which adjusts the inner diameter of the coin stacking portion and the width of the coin passage is formed in a multi-sided shape which corresponds to several types of coins which are the object of processing, and so when a coin packaging machine is exported to another country, for example, there is the problem that a cam which corresponds to the currency of the country which is the destination of export has to be specially incorporated into the coin packaging apparatus, thereby preventing mass production of the coin packaging apparatus.

Furthermore, when there is an increase in the number of types of coins and denominations, or when there is a change in the diameter of a coin or coins, the cams inside the coin packaging apparatus have to be replaced with new ones, and this involves the problems of the time and expense required for the changeover work.

In the light of these problems, the present invention has as an object the provision of a coin packaging apparatus for coin currencies of all countries which can correspond to any type of coin, thereby facilitating the coin type changing operation for the coins to be processed.

SUMMARY OF THE INVENTION

In order to solve the problems associated with the conventional apparatus, the present invention is a coin packaging apparatus which feeds coins one by one from a circular plate and conveys them along a coin passage in which processing, such as totaling and stopping of the coins to be packaged, is performed for small-diameter coins. The coins are then fed to a coin stacking portion provided at the end of the coin passage and are successively stacked. When a required number of coins has been stacked, those stacked coins are sent to a packaging portion and are packaged in paper packaging. This coin packaging apparatus of the present invention is characterized in being provided with a coin passage width adjustment means which steplessly adjusts the passage width of the coin passage, a coin passage height adjustment means which steplessly adjusts the passage height of the coin passage, a coin stacking portion inner diameter adjustment means which steplessly adjust the inner diameter of the coin stacking portion, a coin information storage means which stores coin information of at least the diameter and thickness of coins to be processed and in correspondence with the type of coin, a coin type specification means which specifies the type of coin to be processed, and a control portion which determines the inner diameter of the coin stacking portion and the height and width of the coin passage portion from coin information of the coin information storage means and on the basis of the coin type specification from the coin type specification means, and operates each of the adjustment means to those determined dimensions.

In addition, the present invention has the configuration described above and is further provided with a coin information input means for the input of coin information, including at least the thickness and diameter of a coin to be processed, a coin information storage means which stores the coin information input by the coin information input means so as to correspond to the coin type, a coin type specification means which specifies the coin type of the coins to be processed, and a calculation means which uses the coin information to calculate the inner diameter of the coin stacking portion and the height and width of the coin passage suited for processing the coin type. A control portion uses specifications by the coin type specification mechanism as the basis for operating each of the adjustment mechanisms so that there is agreement with the calculation results of the calculation means.

In addition, the present invention is further provided with a fine adjustment means for the direct input of the inner diameter of the coin stacking portion and the height and width of the coin passage suited to processing the coin type.

With the first embodiment of the present invention, when there is a specification of a coin type by the coin type specification means, the control portion reads the coin information for that specified coin type from the coin type information storage means, and determines the inner diameter of the coin stacking portion and the width and height of the coin passage so that they are suited to the diameter and thickness of the coins. A control portion operates the coin passage width adjustment means, the coin passage height adjustment means and the coin stacking portion inner diameter adjustment means so that they are steplessly adjusted and so that their dimensions are adjusted to be in agreement with the specified coin type.

With the second embodiment of the present invention, when the coin type specification means specifies a coin type, the coin information for coins of the type, which is input beforehand to the coin information storage means by the coin information input means, is used as the basis for the calculation means to calculate the inner diameter of the coin stacking portion and the width and height of the coin passage. The control portion operates the coin passage width adjustment means, the coin passage height adjustment means, and the coin stacking portion inner diameter adjustment means so that the inner diameter of the coin stacking portion and the width and height of the coin passage are made to agree with the calculated values.

With the third embodiment of the present invention, when the coin type specification means specifies a coin type, the coin information for coins of the type, which is input beforehand to the coin information storage means by the coin information input means, is used as the basis for the calculation means to calculate the inner diameter of the coin stacking portion and the width and height of the coin passage, and the control portion operates the coin passage width adjustment means, the coin passage height adjustment means, the coin stacking portion inner diameter adjustment means and the fine adjustment means so that the inner diameter of the coin stacking portion and the width and height of the coin passage are made to agree with the calculated values.

BRIEF DESCRIPTION OF THE DRAWINGS

In the appended drawings,

FIG. 15 is a block diagram showing the storage contents of a storage portion.

DETAILED DESCRIPTION OF THE PREFERRED EMBODIMENTS

The following is a description of preferred embodiments of the present invention, with reference to the appended drawings.

Figure 1:
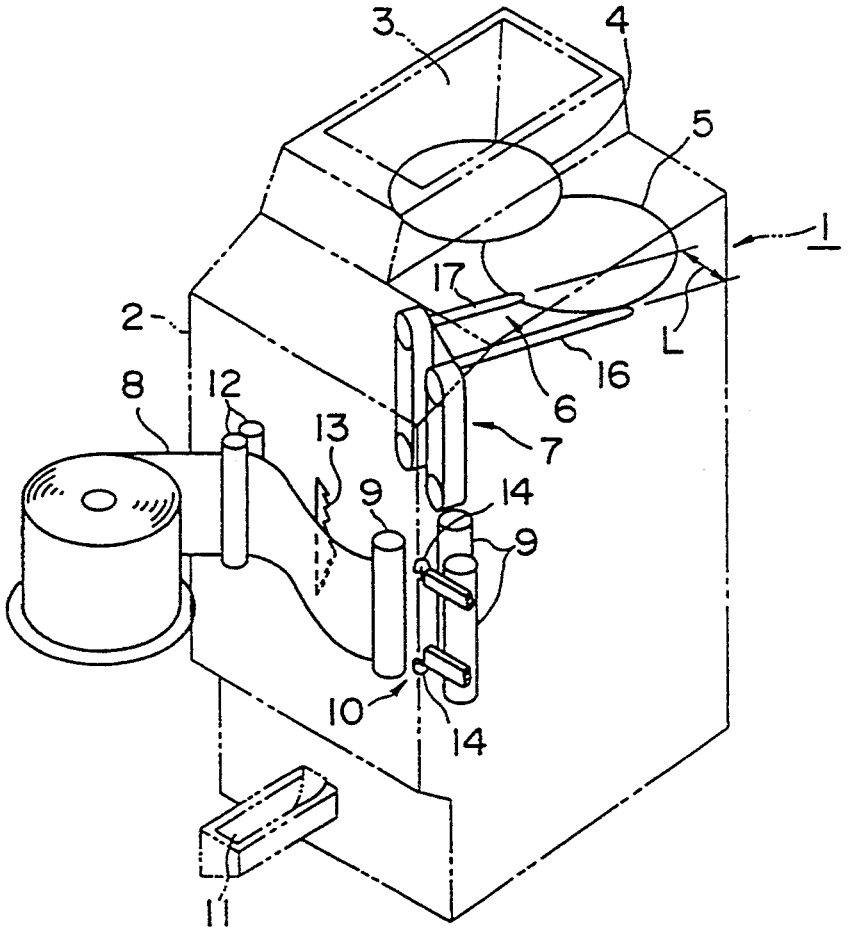
FIG. 1 is a perspective view showing an outline of a coin packaging apparatus to which the present invention has been applied.

As shown in the outline of FIG. 1, a coin packaging apparatus 1 is provided with a rotating plate 4 which receives and supplies coins from inside a coin insertion hopper 3, which opens to the top of a machine unit 2. A rotating plate 5 receives coins supplied form the rotating plate 4, both plates being freely rotatable, and opposite the rotating plate 5 is arranged a coin passage 6 substantially tangential thereto which performs separation and counting processing for the coins. At one end of the coin passage 6 is a coin stacking portion 7 which counts a certain number of coins. At a lower portion of the coin stacking portion 7 is provided a packaging portion 10 with three packaging rollers 9 which receive the coins stacked by the coin stacking portion 7 and package them with packaging paper 8. The coins packaged here are discharged from an outlet 11 in a lower portion of the machine unit 2. In FIG. 1, 12 is a packaging paper feed roller, 13 is a cutter for cutting the packaging paper 8 to a required length, and 14 are folding heads for folding the upper and lower ends of the packaging paper 8 which has been wound around the roll of coins.

Figure 2:
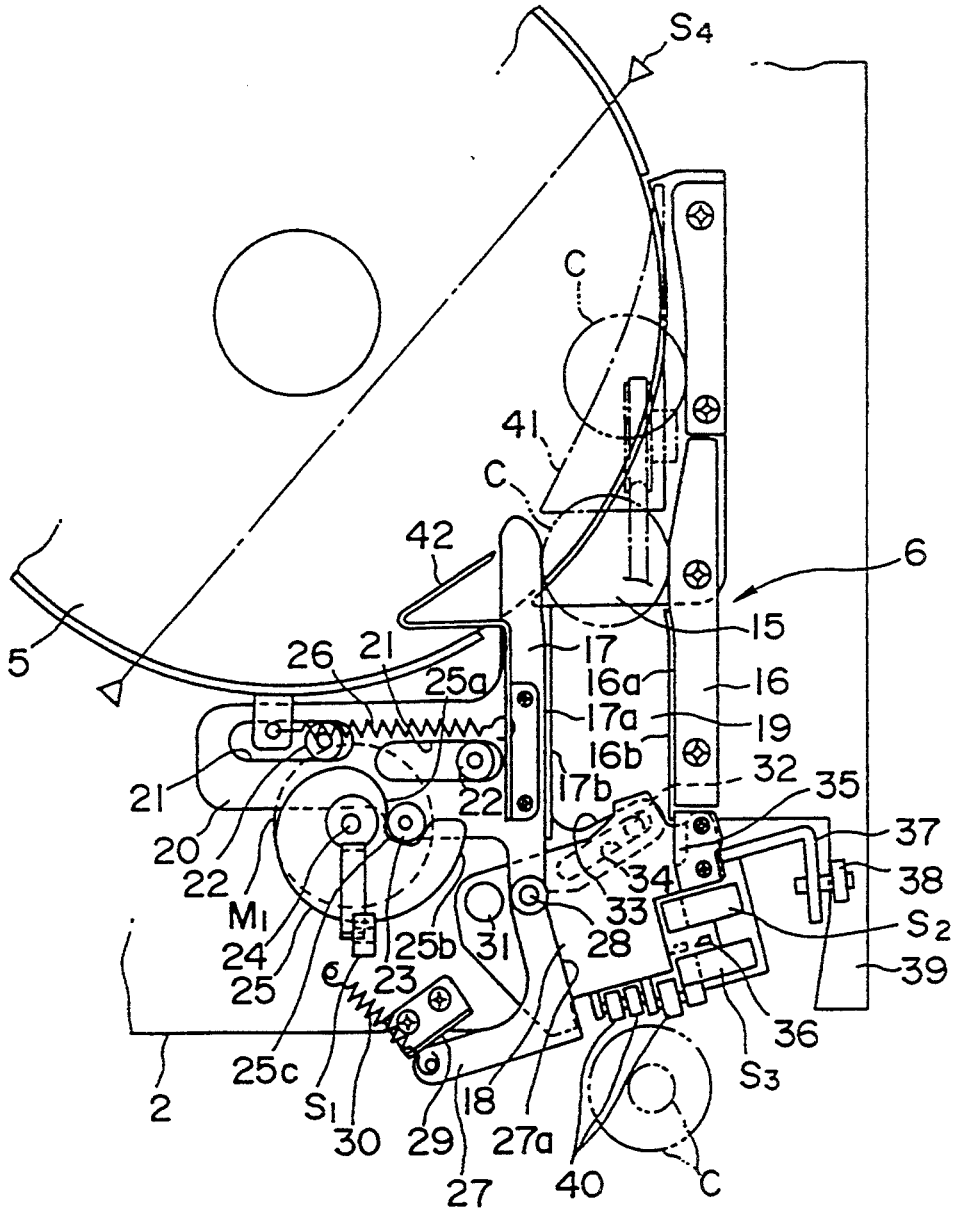
FIG. 2 is a plan view of a coin passage portion processing large-diameter coins.

As shown in FIG. 2, the inlet portion of the coin passage 6 has a passage inlet bottom plate 15 in substantially the same plane as the rotating plate 5, a fixed passage member 16 and a moving passage member 17, the width L (see FIG. 1) of which is determined so as to correspond to a coin diameter. The members 16 and 17 are provided after the passage inlet bottom plate 15, and a passage exit bottom plate 18 is provided downstream of the fixed passage member 16 and the moving passage member 17. There is a small-diameter coin exclusion hole 19 provided between the passage inlet bottom plate 15 and the passage exit bottom plate 18.

The following is a description of the configuration of the coin passage, which includes a passage width adjustment portion 141 as a coin passage adjustment means.

Figure 3:
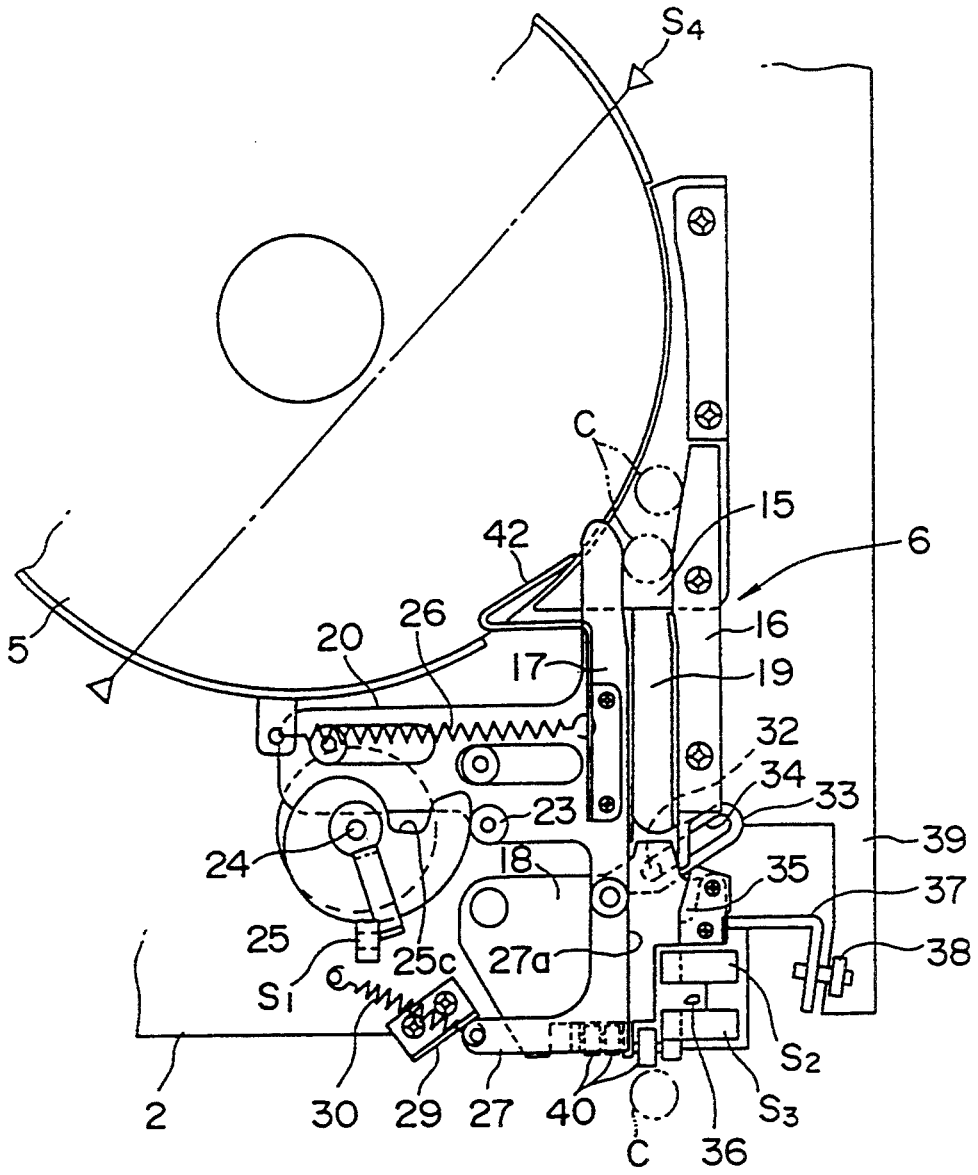
FIG. 3 is a plan view of a coin passage portion processing small-diameter coins.

FIG. 2 shows the coin passage when there is a status of maximum width, while FIG. 3 shows the coin passage when there is a status of minimum width.

As shown in FIG. 2, the moving passage member 17 has an extending portion 20 which extends horizontally in a direction to the rear of a straight edge portion 17*b*, which has a step 17*a*, and which configures the coin passage 6. This extending portion 20 engages with guide rollers 22 which turn in long holes 21 on the side of the machine unit 2 and which extend in a direction perpendicular to the edge portion 17*b*, and are supported so that the moving passage member 17 can move in a straight line to advance towards and retreat from the fixed passage member 16. A cam follower 23 is pivotably mounted on the extending portion 20 and is urged by a spring 26 so that it is always in contact with a peripheral surface of a stepless cam 25, which is provided so as to be rotatable about a center of a pivot 24 on the side of the machine unit 2.

This stepless cam 25 has a spiral shape with a radius which increases for a minimum radius portion 25*a* to a maximum radius portion 25*b*. The moving passage member 17 is in the status of maximum opening when the cam follower 23 engages the minimum radius portion 25*a* and with a concave portion 25*c* formed in the stepless cam 25. This status of maximum opening is a set portion. $S_1$ is a coin passage maximum opening portion detection sensor. The cam 25 is rotated through a required angle by a coin passage width adjustment pulse motor $M_1$.

Downstream of the moving passage member 17 is an auxiliary passage member 27 which has an L-shape when seen in plan, and which is connected at one end by a pin 28, while the other end of this auxiliary passage member 27 is urged by a spring 30 so that it is in contact with a guide 29 fixed to the side of the machine unit 2. The position of a contact surface 27*a* changes with movement of the auxiliary passage member 27, and the edge portion 17*b* of the moving passage member 17 is at a slightly angled position with respect to the member 27, as shown in FIG. 2, when the passage width increases. It changes to a linear shape with respect to the edge portion 17*b* of the moving passage member 17 when the passage width decreases. Even if there is a change in the passage width, the distal end of the coin passage 6 moves towards the center of the coin stacking portion 7, and the distal end of the contact surface 27*a* of the auxiliary passage member 27 approaches the coin stacking portion 7.

The distal end portion of the side passage exit bottom plate 18 on the side of the moving passage member 17 is supported by a pivot 31 so as to be freely rotatable on the side of the machine unit 2. A pin 32 provided on the bottom surface of this passage exit bottom plate 18 engages with a long hole 34 of a portion 33 which extends on the side of the moving passage member 17, which is on the side of the coin passage 6. Movement of the moving passage member 17 to narrow the passage width causes the passage exit bottom plate 18 to rotate, via the pin 32, in the clockwise direction in the figure about the pivot 31.

To the side of the free end of the passage exit bottom plate 18 are provided an auxiliary passage member 35, which is on a line extending from the edge portion 16*b* of the fixed passage member 16 which has the step 16*a*, a sensor $S_2$ for counting the number of passes of coins to the downstream side thereof, and a sensor $S_3$ for checking whether a coin has passed. Between these sensors $S_2$ and $S_3$ is provided a stopper 36, which acts due to a solenoid (not shown) to stop passage of following coins once a required number of coins has passed. This stopper 36 is provided so that it enters into the path of passing coins. In addition, on the side of the free end of the passage exit bottom plate 18 is supported a bottom plate support roller 38 via an arm 37. This roller 38 supports the free-end side of the passage exit bottom plate 18, and is placed on the flat plate 39 on the side of the machine unit 2. Furthermore, on the side of the opening of the passage exit bottom plate 18 are mounted rollers 40, which guide the lower surfaces of the coins. The auxiliary passage member 35, coin total number count sensor $S_2$ and coin passage detection sensor $S_3$ are arranged so that a virtual line linking them is close to parallel with respect to the contact surface 27*a* of the auxiliary passage member 27 on the side of the moving passage member 17. In FIG. 2, $S_4$ is a sensor which detects the presence and the level of a coin on the rotating plate 5, while 41 is a thickness regulating member which prevents two overlapping coins from entering the coin passage 6 by creating a gap which is larger than the thickness of one of the coins being handled but smaller that the thickness of two coins. In addition, 42 is a guide plate which is placed on the rotating plate 5 and mounted to the moving passage member 17, and which ensures that the coins which are moved on the rotating plate 5 are led downstream in the direction of rotation and do not remain. C represents a coin.

The following is a description of a passage height adjustment portion 142, which is an adjustment means for the coin passage height. This adjustment portion is realized by height adjustment of the thickness regulating member 41 and a conveyor belt 43, which is in contact with the upper surface of coins fed in the coin passage 6 and conveys the coins downstream.

Figure 4:
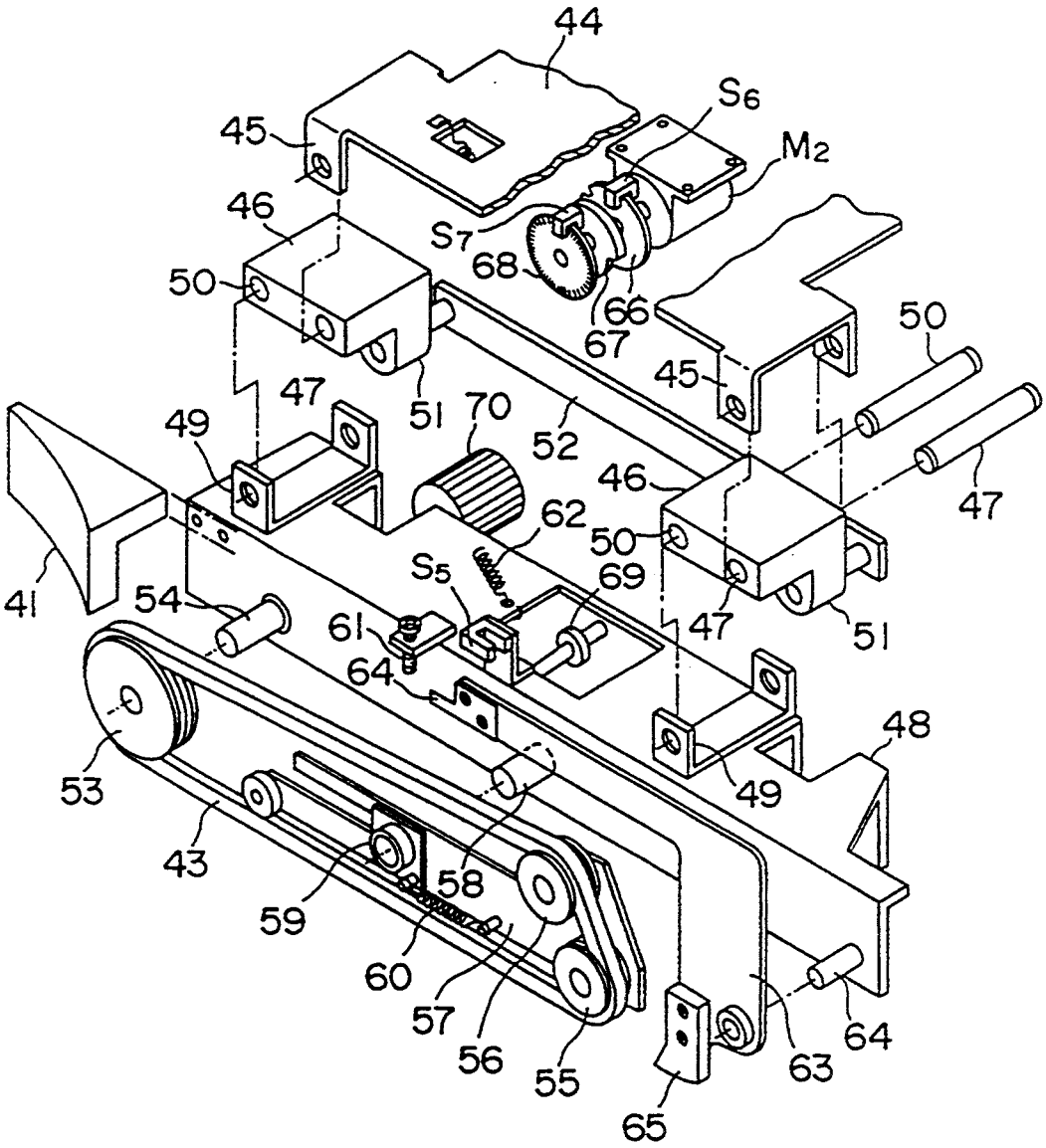
FIG. 4 is an exploded perspective view of a passage height adjustment mechanism of a coin passage portion.
Figure 5:
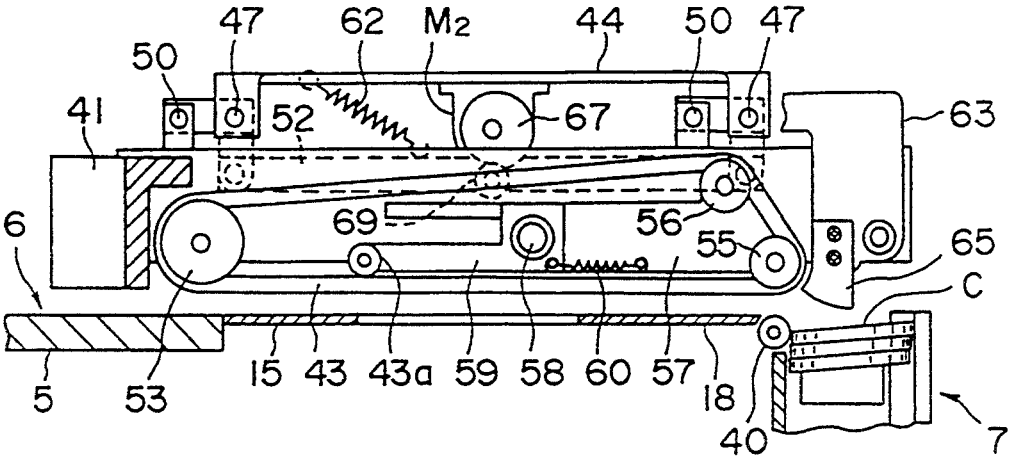
FIG. 5 is a sectional view of a coin passage portion processing thick coins.
Figure 6:
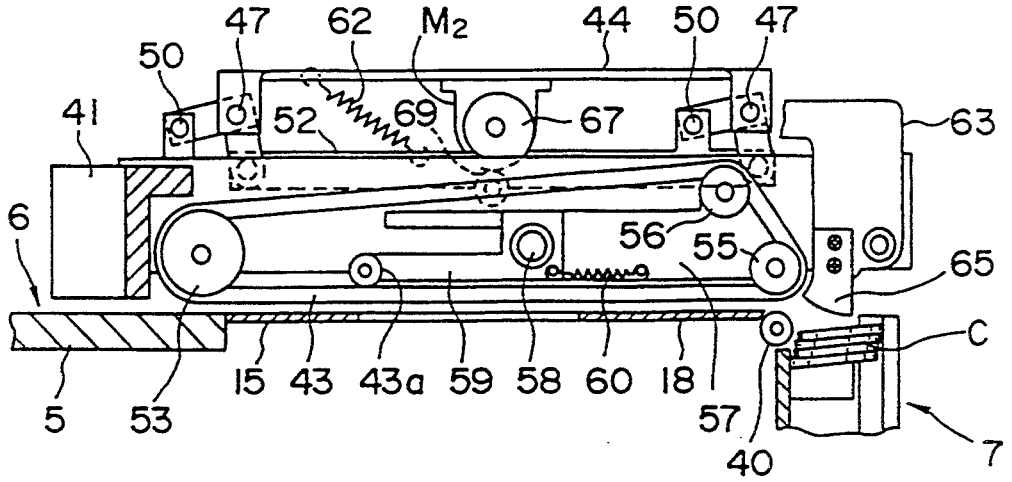
FIG. 6 is a sectional view of a coin passage portion processing thin coins.

The support mechanism for this conveyor belt 43 is shown in the exploded perspective view of FIG. 4, while FIG. 5 and FIG. 6 are sectional views of the cases when the height of the conveyor belt 43 is at its highest position and its lowest position. The ends of two blocks 46 are pivoted by pivots 47 to forward and rear bearings 45 of a fixed plate 44, which is fixedly provided on the side of the machine unit 2. At opposite ends of these blocks 46 are bearing portions 49, which are provided on the upper portion of the moving frame 48 and pivoted by pivots 50. Furthermore, bearing portions 51 at the lower end of the blocks 46 are linked by a link 52, which configures a parallel four-jointed link mechanism.

A pulley 53 on an inlet side of the conveyor belt 43 is mounted by a pivot 54 to a side surface of the moving frame 48. Pulleys 55 and 56 on the downstream end of the conveyor are pivotably mounted to a rocker plate 57. The center portion of this rocker plate 57 is pivoted by a pivot 58 on the side surface of the moving frame 48. The end of the rocker plate 57 is in contact with a stopper 61 mounted to the moving frame 48 so that the drop of the pulleys 55 and 56 is regulated. A tension spring 60 is fixed between the rocker plate 57 and a member 59 which has a pressing roller 43. This spring acts to press upwards at a constant force, irrespective of the position of the height of the moving frame 48. It allows the rocket plate 57 to escape upwards when thick coins have entered. A tension spring 62 is stretched between the moving frame 48 and the fixed plate 44 and always urges the moving frame 48 in the upward direction.

The base portion of a detection plate 63 is pivoted by a pivot 64 on the downstream end of the moving frame 48. In the vicinity of the pivot 64 is provided a contact portion 65 which detects the height of coins stacking at the upper portion of the coin stacking portion 7. A detection portion 64a at the distal end relates to a photo-sensor $S_5$ provided on the moving frame 48, and when the photo-sensor $S_5$ is activated by the detection portion 64*a*, there is a detection that there is no longer an empty upper portion of the coin stacking portion 7.

On the lower surface of the fixed plate 44 is provided DC motor $M_2$, and on the shaft which is rotated by this motor are fixed a set position detection plate 66, a stepless cam 67 and a rotation angle detection slit plate 68. On the periphery of the set position detection plate 66 is provided a coin passage set position detection sensor $S_6$, while on the periphery of the rotation angle detection slit plate 68 is provided a rotation angle detection sensor $S_7$.

A cam follower 69, pivoted at a center position of the moving frame 48, is in contact with the stepless cam 67, and the rotation of the stepless cam 67 moves the moving frame 48 up and down via the cam follower 69, so that the position of contact of the cam follower 69 is a set position at the position of minimum radius of the stepless cam 67. In addition, to the end of the inlet portion of the moving frame 48 is fixed a thickness regulating member 41. The height of the thickness regulating member 41 is also adjusted to the thickness of the coins being handled in accordance with the rise and fall of the moving frame 48. In the figure, 70 indicates a pulley which receives the rotational force from the drive motor of the conveyor belt 43.

The following is a description of a configuration which includes a coin stacking portion inner diameter adjustment portion 143, which is the inner diameter adjustment means for the coin stacking portion.

Figure 7:
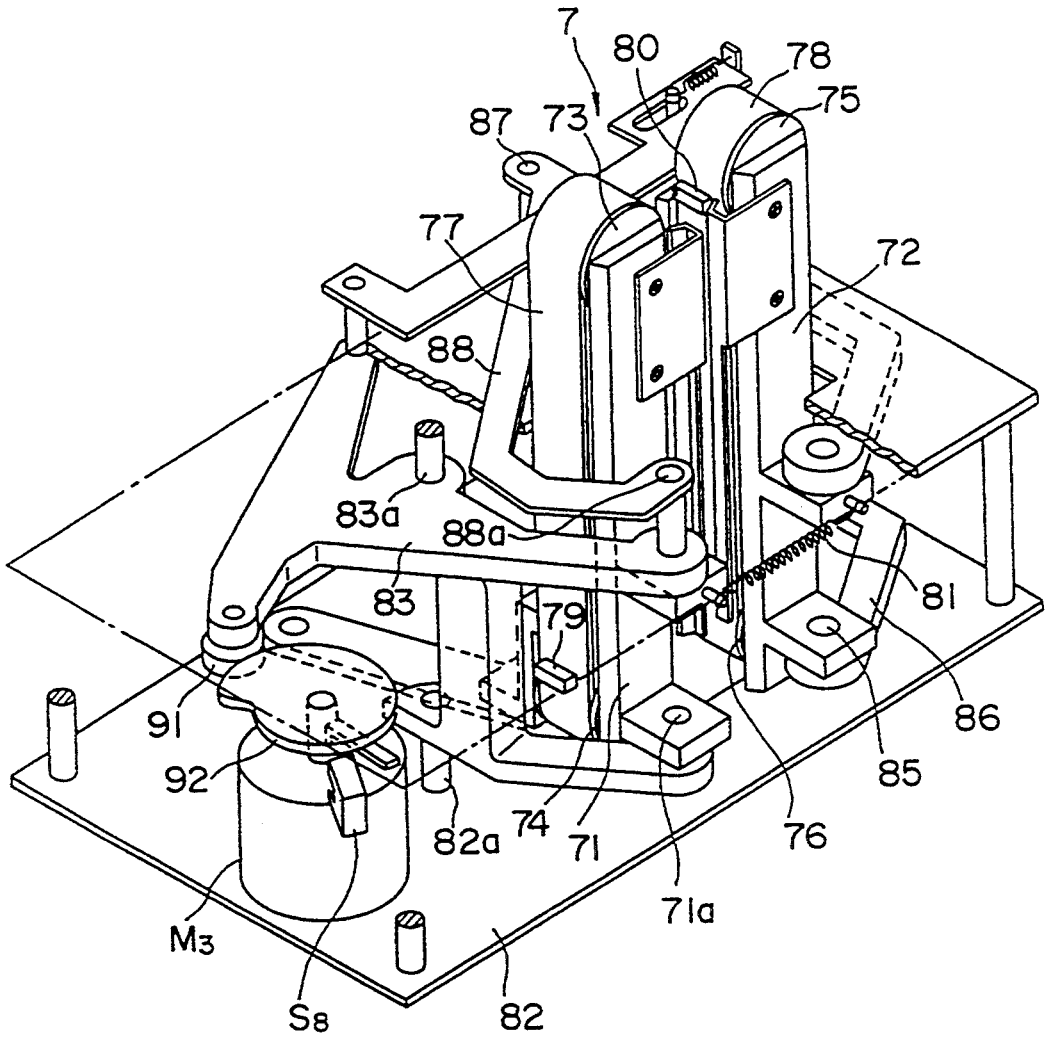
FIG. 7 is a perspective view of a coin stacking portion.
Figure 8:
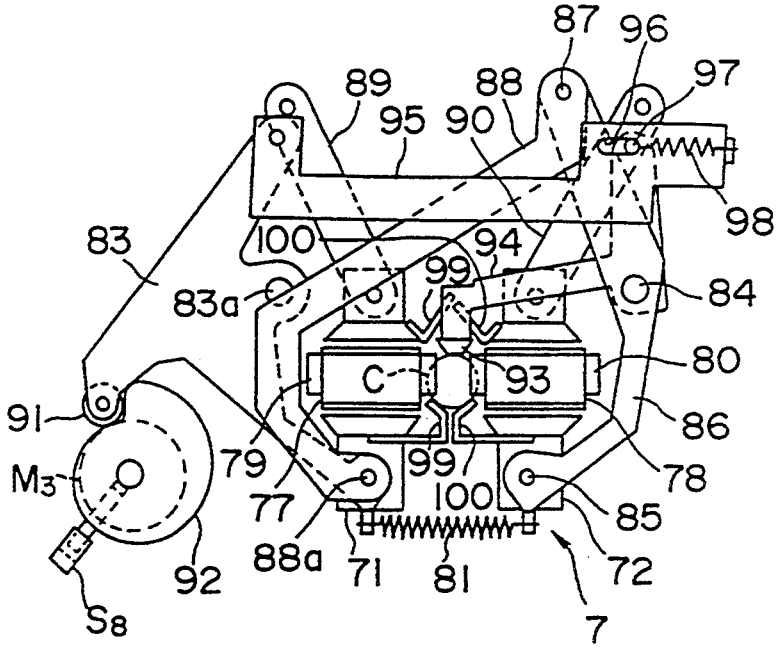
FIG. 8 is a plan view of a coin stacking portion processing small-diameter coins.
Figure 9:
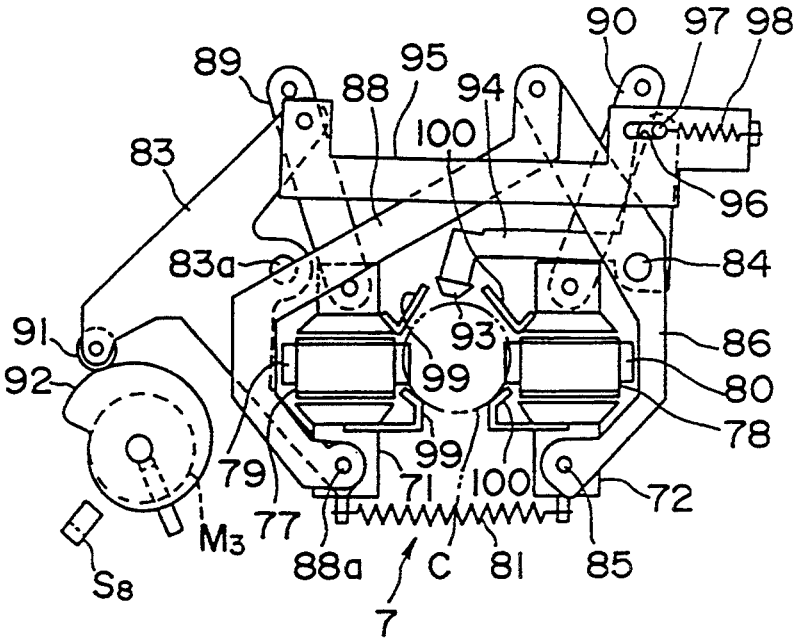
FIG. 9 is a plan view of a coin stacking portion processing large-diameter coins.

As shown in the perspective view of FIG. 7, and the plan views of FIG. 8 and FIG. 9, left and right belts 77 and 78 are wound around pulleys 73 and 74, and 75 and 76, respectively. The pulleys are pivoted on and form pairs on the upper and lower portions of left and right blocks 71 and 72. Coins are in a stacked state between opposing surfaces of these belts 77 and 78, and coin support portions 79, 79, 80 and 80 protrude from the outer surfaces of the belts 77 and 78 at symmetrical positions on the left and right belts 77 and 78. In the example shown in the figure, two coin support portions are provided for one revolution of the belts 77 and 78. The left and right blocks 71 and 72 are urged toward each other by a tension spring 81.

A parallel link mechanism enables stepless adjustment of the blocks 71 and 72 so that they can move towards and away from each other. This link mechanism comprises a first link 83 which has its central portion supported so as to be freely rotatable in a horizontal plane by a pivot 83*a* on a base 82. The mechanism is linked to the block 71, which is pivoted by a pivot 71*a* at a distal end thereof. A second link 86 has its central portion supported so as to be freely rotatable in a horizontal plane by a pivot 84 on the base 82 and has a distal end having the block 72 linked thereto by a pivot 85. A third link 88 has one end 88a linked to the block 71 by the pivot 71*a* and the other end linked to another end of the second link 86 by a pin 87. Fourth and fifth links 89 and 90 each have one end linked to a surface opposite the respective one of the blocks 71 and 72 and the other end pivoted on the base 82. A cam follower 91 pivoted on the other end of the first link 83 is in contact with the peripheral surface of a stepless cam 92, which is rotated by a pulse motor $M_3$ provided on the base 82. The minimum gap position between the belts 77 and 78, that is, the minimum radius position of the stepless cam 92, is used as the set position. The position is detected by a coin stacking portion set position detection sensor $S_8$.

A central portion of a lever 94, which has at its distal end a closing member 93 which closes an open space at the coin entry side between the belts 77 and 78, is pivoted on the pivot 84 on the base 82. A pin 97 at the other end of the lever 94 engages and is freely linked with a long hole 96 at one end of a link 95, which is in turn linked to the other end portion of the first link 83. The lever 94 is always urged by a tension spring 98 in the direction of separation from the coin stacking portion 7. Guide levers 99 and 100 are fixed to the blocks 71, 72 so as to prevent the escape of coins when the coins are stacked.

Figure 10:
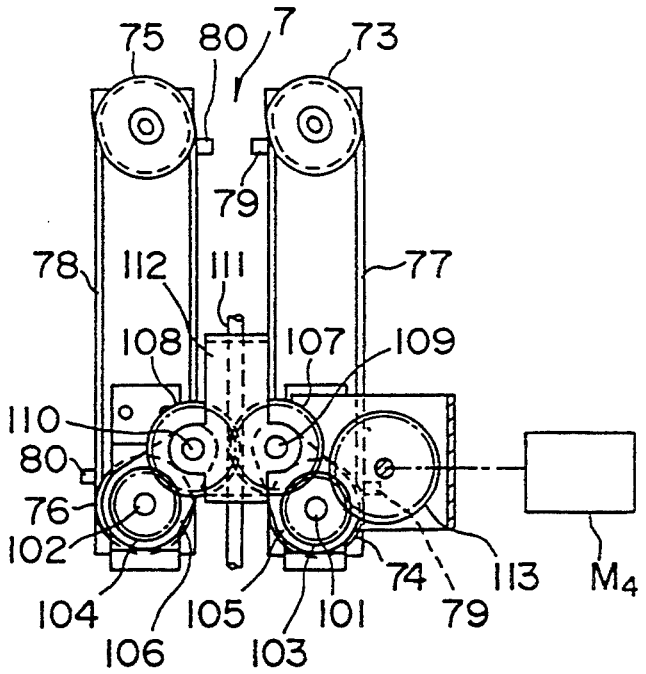
FIG. 10 is a front elevational view showing the status of a drive system of a coin stacking portion processing small-diameter coins.
Figure 11:
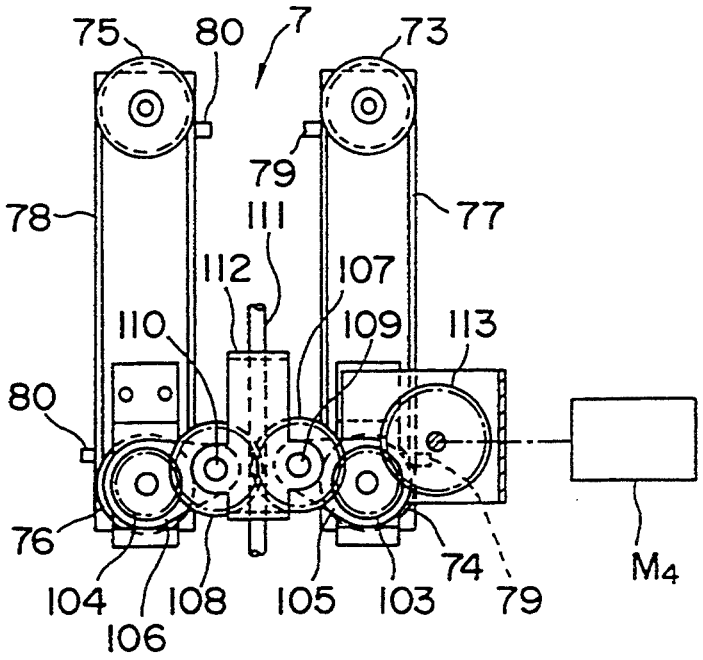
FIG. 11 is a front elevational view showing the status of a drive system of a coin stacking portion processing large-diameter coins.

As shown in FIG. 10 for the state when coins of a small diameter are stacked, and in FIG. 11 for the state when coins of a large diameter are stacked, the drive means for the belts 77 and 78 of the coin stacking portion 7 is configured from gears 103 and 104 fixed to shafts 101 and 102 of the pulleys 74 and 76 of the lower portion of the belts 77 and 78. Arms 105 and 106, which engage with the shafts 101 and 102, are supported by them so as to be freely rotatable. A member 112, which can be freely raised and lowered along a vertical guide rod 111, is supported by shafts 109 and 11 of gears 107 and 108. A drive gear 113 is rotated by a pulse motor $M_4$ and engages with the gear 103 on the shaft of the pulley 74, and each of the gears 103, 107, 108, 104 are always engaged. Accordingly, even if there is a change in the interval between the belts 77 and 78, the rotation of the drive gear 113 is always transmitted to the left and right pulleys 74 and 76.

Moreover, the packaging portion 10 of the conventional configuration is able to correspond to any type of coin, and so the conventional configuration, details of which are therefore omitted here, is used.

Figure 12:
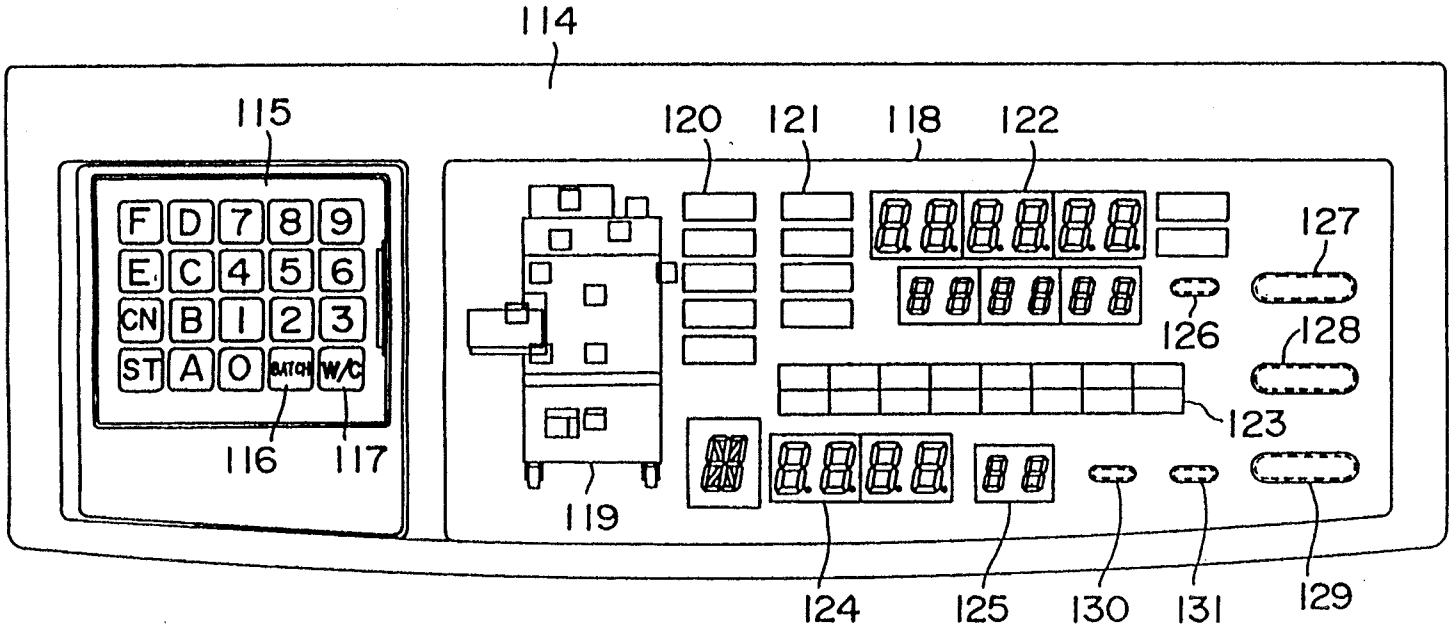
FIG. 12 is a view showing an operation panel.

The following is a description of an operation and display panel portion 144, which is provided on the inclined portion at the top front of the coin packaging apparatus 1. As shown in the layout example of FIG. 12, this panel portion 114 has a key portion 115 having a ten-key pad on one side, and also includes a specification button for the number of batches in the totaling mode and the number of batches in the packaging mode, and a mode switching button 117 for packaging and totaling. The operation of the key portion 115 enables the input of the type, diameter, thickness and packaging unit number for the coins to be processed. In addition, the other side of the panel portion 114 is a display portion 118 and includes a position display portion 119, which indicates the place at which some abnormality has occurred, a contents display portion 120 which indicates the type of abnormality, a mode display 121 for the total number, batch and the like, a display 122 for the number of coins/rolls, a stored coin type display 123 for written entry in which is written the type of coins for which coin information is stored, a coin type display 124 which shows the currently specified coins, and a packaged roll number display 125 which shows the current number of coins. Separately from this are a coin/roll number switching button 126, a clear button 127, a start button 128, a stop button 129, a down button 130 and an up button 131 which specify the coin type for processing, and which successively display the display contents displayed in the coin type display and the packaging coin number display 125 in the order of storage, that is, in the order in which they were recorded in the stored coin type display 123.

Figure 13:
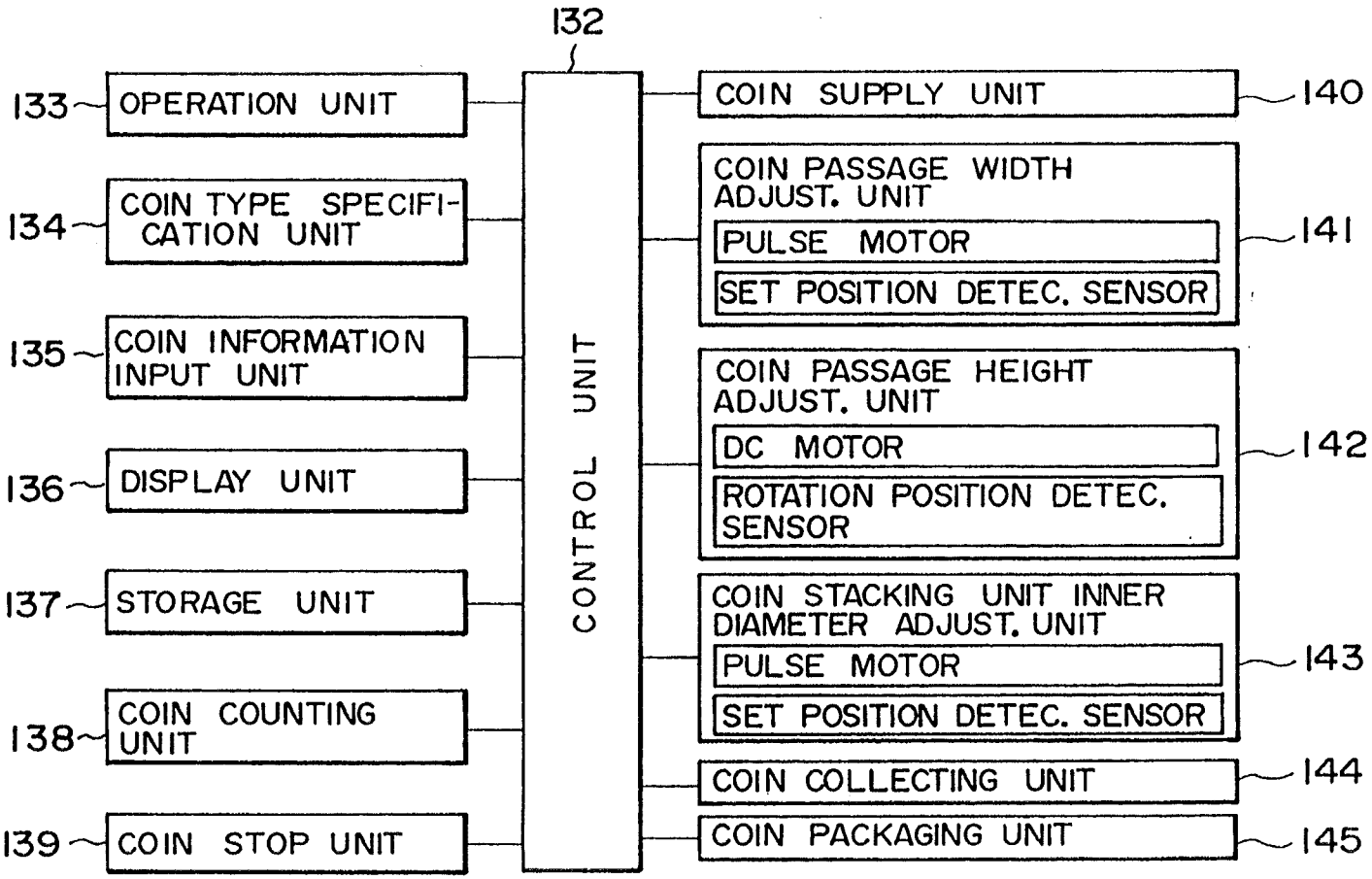
FIG. 13 is a control block diagram.

FIG. 13 is a block diagram showing one example of a control system. A control unit 132 is a control portion which controls the entire coin packaging apparatus, and signal receive and send is performed with respect to each portion in the manner described below. An operation unit 133 comprises the start button 128, the stop button 129, the clear button 127, the coin/roll number switching button 126, the mode switching button 127, the specification button 116 and the like. A coin type specification unit 134 comprises the coin type display 124, the packaging coin number display 125, the down button 130 and the up button 131, and is a coin type specification means for specifying the type of coin to be processed.

A coin information input unit 135 includes the key portion 115 and includes a method for the prior storage of coin information in an information storage media such as a ROM or an IC card or the like, and for the input of coin information to it. A display unit 136 comprises the position display unit 119, the contents display unit 120, the mode display 121, the number of rolls/coins display 122 and the stored coin type display 123.

A storage unit 137 stores coin information which has been input by the coin information input unit 135 so that there is a correspondence with the coin type, and therefore corresponds to the coin information storage means disclosed herein. Moreover, storage unit 137 uses an EEPROM, for example, so that the stored contents are not erased even if the power is cut.

A coin counting unit 138 comprises the passed coin total number count sensor $S_2$ and the coin passage detection sensor $S_3$, and a coin stop unit 139 comprises the stopper 36 and a solenoid (not shown). A coin supply unit 140 comprises the rotating plates 4 and 5 and the motors which drive them, and a passage width adjustment unit 141 is configured from the pulse motor $M_1$, the portion detection sensor $S_1$ and the stepless cam 25. In addition, a passage height adjustment unit 142 comprises a configuration having the DC motor $M_2$ and a rotation position detection sensor comprising the position detection sensor $S_6$ and the rotation angle detection sensor $S_7$, while a coin stacking portion inner diameter adjustment unit 143 is a configuration comprising the pulse motor $M_3$, the set position detection sensor $S_8$ and the stepless cam 92.

A coin stacking unit 144 comprises a pair of belts 77 and 78 and the pulse motor $M_4$ which rotates the belts 77 and 78, while a coin packaging unit 145 comprises the three packaging rollers 9 and the motors and the like which rotationally drive them (not shown).

The following is a description of the operation of the embodiment described above.

First, when the coin packaging apparatus is shipped, the coin information input unit 135 is used to set coin information such as the type of coins, their thickness, their diameter and the packaging coin number unit and other information about the currency of the shipment or export destination in a ROM or an IC card, and this coin information is stored in the storage unit 137. If there is a partial change in the coin information or if there is an addition of one type of coin, then this can be performed by operating the key portion 115 at the shipment destination. All of the coin information can be input by operating the key portion 115.

FIG. 15 is a block diagram showing storage contents of the storage unit 137. The following is a description of one example of the storage contents of the coin block 1.

In a first storage region 151 is stored the date of update of that coin block. This date of update is given by a clock provided inside the control unit 132 and is automatically set and updated each time input is performed in the normal input mode to be described later.

The diameter D (1) of a coin is stored in a storage region 152 and the thickness T (1) of a coin is stored in a storage region 153. These items of coin information are stored in units of up to 1/100th of a millimeter. Moreover, the units can be selected so that storage can be performed in inches or some other unit.

The coin passage width information $P_1$ is stored in a storage region 154. This $P_1$ indicates the number of input pulses to the pulse motor of the passage width adjustment unit 141 to drive the moving passage member 17 (See FIG. 1) so that the selector groove width L (See FIG. 1) can be made a required value, and is either calculated by the control unit 132 in accordance with the diameter D (1) of the coin or is directly input by a special input mode to be described later, and stored.

The equation for calculation is ($\alpha_1 \geqq D(1) > \alpha_2$) when the diameter of the coins is large, ($\alpha_2 \geqq D(1) > \alpha_3$) when the diameter of the coins is medium, or ($\alpha_3 \geqq D(1)$) when the diameter of the coins is small. These $\alpha_1$–$\alpha_3$ are different values of the design values of the moving passage member 17 and the like.

When ($\alpha_1 \geqq D(1) > \alpha_2$), $P_1$ is given by $$P_1 = \frac{C_1 - D(1)}{C_2}$$

Here, the values of $C_1$ and $C_2$ differ according to the design values for the moving passage member 17.

In the same manner, when ($\alpha_2 \geqq D(1) > \alpha_3$), $P_1$ is given by $$P_1 = \frac{C_1 + 0.06 - D(1)}{C_2}$$

and when ($\alpha_3 \geqq D(1)$), $P_1$ is given by $$P_1 = \frac{C_1 + 0.1 - D(1)}{C_2}$$

The coin passage height information $P_2$ is stored in a storage region 155. This $P_2$ indicate the number of output pulses of the rotation angle detection sensor $S_7$ to rotate the DC motor $M_2$ to make the thickness regulating member 41 (see FIG. 4) the required height. More specifically, the DC motor $M_2$ stops when the number of output pulses of the rotational angle detection sensor $S_7$ since the start of rotational drive of the DC motor $M_2$ has reached the number $P_2$.

This $P_2$ can either be calculated by the control unit 132 using the thickness T(1) of the coins, or can be directly input by a special input mode to be described later. The equation for calculation is given as the following.

$$P_2 = \frac{C_3 - T(1)}{C_4}$$

Moreover, $C_3$ and $C_4$ use values which differ according to the design values and the like for the thickness regulating member 41. The coin stacking portion inner diameter information $P_3$ is stored in a storage region 156. This $P_3$ indicates the number of input pulses to the pulse motor of the coin stacking portion inner diameter adjustment portion 143 so that the setting for the gap between the bets 77 and 78 (See FIG. 7) can be changed in accordance with the diameter D(1) of the coins, and can either be calculated by the control portion 132 or can be directly input by a special input mode to be described later. The equation for calculation in accordance with the diameter of the coins is given as the following.

$$P_3=(C_5\times D(1)-C_6)+6 \text{ for } \beta_1<D(1)\leqq\beta_2$$

$$P_3=(C_5\times D(1)-C_6)+5 \text{ for } \beta_2<D(1)\leqq\beta_3$$

$$P_3=(C_5\times D(1)-C_6)+5 \text{ for } \beta_3<D(1)\leqq\beta_4$$

This is to say that various integers are added to $(C_5\times D(1)-C_6)$ in accordance with the diameter D(1). Moreover, $C_5$, $C_6$, and $\beta_1$, $\beta_2$, . . . use values which are respectively different in accordance with the design values of the belts 77 and 78.

The coin support portion lowering pattern is stored in a storage region 157. This coin support portion lowering pattern is information which determines the drive pattern of the belts 77 and 78 and the lowering pattern of the coin support portions 79 and 80 provided on the belts 77 and 78. The coin support portions 79 and 80 lower as coins are stacked one by one, but the amount of lowering is not always constant, but rather changes in accordance with a constant pattern. The coin support portion lowering pattern is information which expresses the change pattern for the amount of lowering, and is determined in accordance with the thickness T(1) of the coins, but is the same as that which has been described in detail in Japanese Patent Laid-Open Publication No. 17704-1991. Moreover, the storage unit 137 holds the coin support portion lowering pattern as a table which has been determined beforehand in accordance with the thickness T(1) of the coins, and reads this table in accordance with the thickness T(1) of the input coins and stores it in the storage table 157.

The coin type symbol K(1) is stored in a storage region 158 and the coin type numerical value H(1) is stored in a storage region 159. For example, if coin block 1 is a block which stores information relating to a $1 coin, the "$" symbol is digitally displayed in the display portion as the coin type symbol K(1), and "1.00" is stored as the coin type numerical value H(1).

The packaging unit number M(1) is stored in a storage region 160 and indicates the number of coins which are to be in one package.

Moreover, the description was given here using the example of the coin type block 1, but the description is exactly the same for the other coin type blocks 2, 3, . . . .

Figure 14:
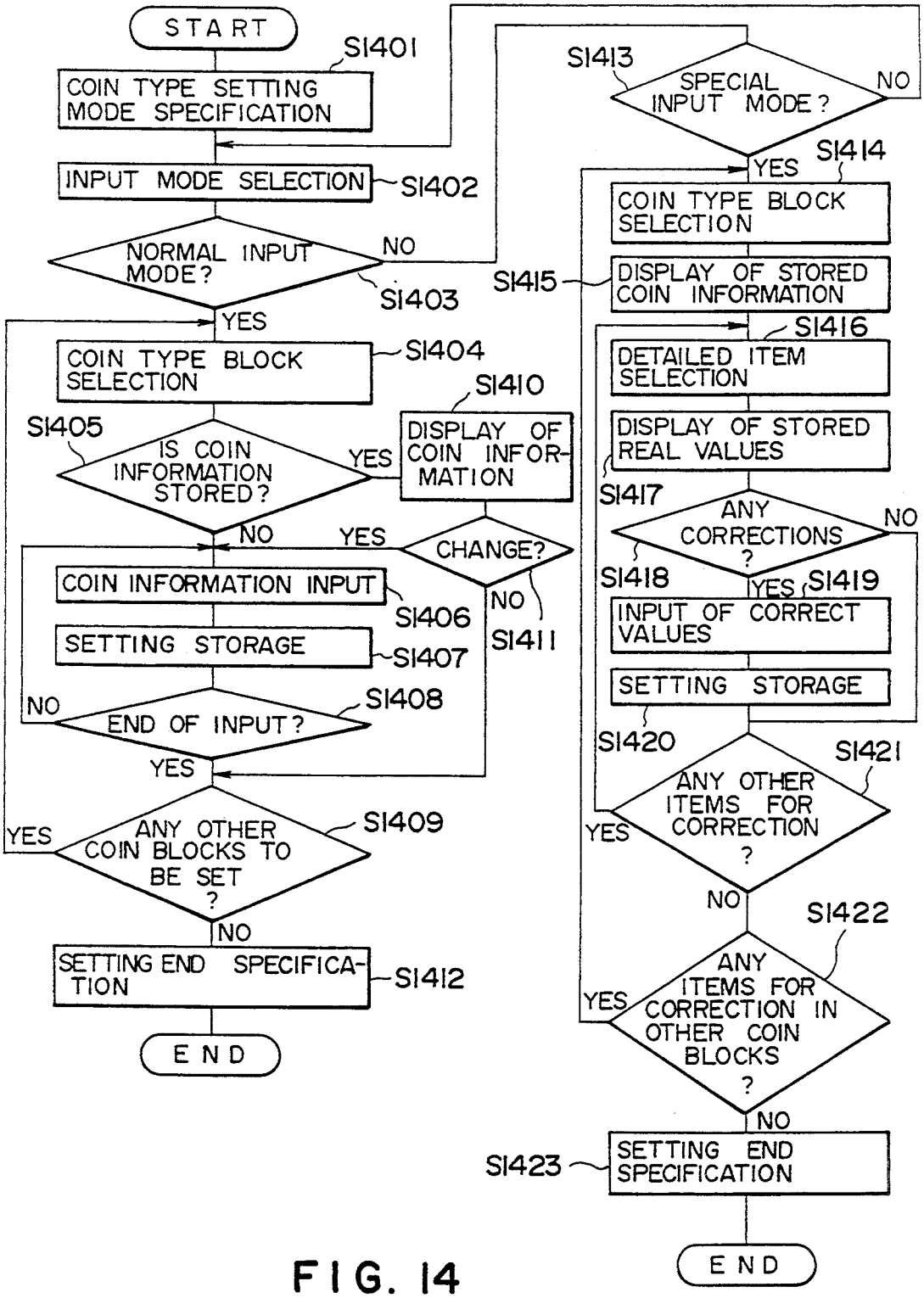
FIG. 14 is a flow chart describing a coin information input operation and a correction operation.

FIG. 14 is a flowchart which indicates the operation procedures for the input and correction of the coin information D(1), T(1) and M(1) described above by operation of the key portion 115.

First, the key portion 115 is operated and the coin type setting mode is specified (S1401). In this embodiment, this mode is specified when the keys "A", "F", and "ST" are pressed in succession. Moreover, the numerical values input by the operations are displayed on the display portions 122, 142 and the like.

The input mode is then selected (S1402). Here, the normal mode is specified when the coin information, which in this embodiment is the diameter and the width of the coins, and the number of coins of the packaging unit, are to be input. The special input mode is selected when the coin passage width information $P_1$, the coin passage height information $P_2$ and the coin stacking portion inner diameter information $P_3$ calculated from the coin information by the control portion 132 are to be fine adjusted. In this embodiment, the successive pressing of the "3" and the "ST" keys specifies the normal input mode, and the successive pressing of the "4" and the "ST" keys specifies the special input mode.

Selection of the coin block is performed (S1404) when it is judged that the normal input mode has been specified as the input mode (S1403). Selection of the coin block is performed using the down button 130 and the up button 131 while observing the coin types which are shown in the upper surface of the storage coin type display 123, and by shifting the selected coin type block until the required coin type block is reached. When coin information is stored for the selected coin type block (S1405) that information is displayed in the display portions 122 and 124 (S1410). In addition, "—" is displayed if coin information is stored for the selected coin type block.

When the coin information of the selected coin type block is to be changed (S1411) and when there is to be the input of coin information to a coin type block for which coin information is not stored (S1405), the key portion 115 is operated for the successive input of each type of coin information (S1406). The control unit 132 successively calculates the coin passage width information $P_1$, coin passage height information $P_2$ and the coin stacking portion inner diameter information $P_3$ on the basis of the input coin information and stores them in the appropriate coin blocks inside the storage portion 137 (S1408). When all of the input information has been input (S1408), there is an end of input with respect to that coin type block.

Here, the diameter D(1) of a coin is first input as the coin information. Doing this first involves pressing the keys "1", "3" and "ST" in sequence, with the mode for the input of the diameter D(1) being selected, and then using the numerical keys to input the diameter in mm units to two decimal places, and finally pressing the "ST" key again. As an example, if 26.50 mm is to be input as the diameter D(1), then the keys "1", "3", "ST", "2", "6", "5", "0" and "ST" are pressed in sequence. When the diameter D(1) is input, the calculations described above are performed and the coin passage width information $P_1$ and the coin stacking portion inner diameter information $P_3$, which are the results of the calculation, are stored in the storage portion 137.

The thickness T(1) of the coin is then input. This first involves pressing the keys "1", "4" and "ST" in sequence with the mode for the input of the thickness T(1) being selected and then using the numerical keys to input the thickness in mm units to two decimal places, and finally pressing the "ST" key again. As an example, if 2.00 mm is to be input as the thickness T(1), then the keys "1", "4", "ST", "0", "2", "0", "0" and "ST" are pressed in sequence. When the thickness T(1) is input, the calculation described above is performed and the coin passage height information $P_2$, which is the result of the calculation, is stored in the storage unit 137.

In addition, the coin support portion lowering pattern is also stored.

The packaging coin number unit is then input as the third item of coin information. This is a numerical value which expresses the number of coins which are to be packaged into a single roll. When this packaging coin number unit is input, the keys "1", "2" and "ST" are pressed in order, then the number keys are used to input the numerical value (a positive integer) and finally the "ST" key is pressed again. As an example, if 25 is to be input as the packaging coin number unit, then the keys "1", "2", "ST", "2", "5" and "ST" are pressed in sequence. The packaging coin number unit is also input as coin information, but it is not necessarily required, as it is set to a predetermined number if its specification has been omitted.

When the input of the coin information has been completed for the appropriate coin type block, the operations from S1404 onwards are repeated for other coin type blocks which have to have input settings.

When there are no more coin type blocks which have to have input setting, the keys "E" and "ST" are pressed in that order, to indicate the end of setting operation (S1412) and the mode shift from the coin type setting mode to the totaling and packaging mode.

When the special input mode is specified in S1402, the specification of the special input mode is recognized by S1413.

The special input mode is information which has been calculated on the basis of coin information which has been input by the normal input mode, and uses manual input to change the coin passage width information $P_1$, coin passage height information $P_2$ and the coin stacking portion inner diameter information $P_3$. This mode is used, for example, when an actual packaging operation has been performed on the basis of the calculated information, and there is some problem with the results, and when it is required to improve the accuracy. Moreover, it is not possible to input the renewal date, the diameter D(1) of the coin or the thickness T(1) of the coin from the special input mode.

In the special input mode, selection of the coin type block is performed (S1414) in the same manner as for S1404. Then, the display portions 122 and 124 display the coin information for the selected coin type block (S1415).

Then there is the specification of the information for changing the setting (S1416). For example, the keys "2", "6" of the key portion 115 are pressed in order when the coin passage width information $P_1$ is to be changed.

When this input is received, the display portion 122 displays the stored values for the coin passage width information $P_1$. When this value is to be corrected, input is performed using the keys of the key portion 115, and the appropriate stored values in the storage portion 137 are rewritten (S1418–S1420). As an example, the keys "2" and "6" of the key portion 115 are pressed in sequence when the coin passage width information $P_1$ is to be changed.

The display portion 122 receives this input and displays the stored value for the coin passage width information $P_1$. When this value is to be corrected, using the keys of the key portion 115 to perform input rewrites the appropriate stored value for the storage portion 137 (S1418–S1420). As an example, when the display portion 122 displays "208" as the stored value, then performing the key input of "210" to slightly reduce the width writes "210" as the value for coin passage width information $P_1$ inside the storage portion 137. Moreover, the selector groove width L, the height of the thickness regulating member 41 and the gap between the belts 77 and 78 are at their widest when in their respective initial states, and so they become smaller for larger values of coin passage width information $P_1$, coin passage height information $P_2$ and coin stacking portion inner diameter information $P_3$.

The operations from S1416 onwards are repeated when rewrite is not to be performed, and when rewrite of other calculation information is to be performed after a rewrite (S1421).

On the other hand, when another rewrite is not be to performed, specification of the end of setting is performed (S1423) in the same manner as for S1412 above, and the coin type setting mode ends.

Moreover, when a coin to be processed is a multi-sided coin, it is not possible to calculate the coin passage width information $P_1$, coin passage height information $P_2$ and coin stacking portion inner diameter information $P_3$, and so it is necessary to use the special input mode for the input of all this information.

The following is a description of the operation when there is actual packaging. Operating the up and down buttons 130 and 131 for the coin type specification unit 134 performs the successive display on the coin type display 124 of the type of coin which is stored in the storage unit 137, and the coin type for processing is specified when the display is stopped at the coin type which is to be processed. In addition, the packaging coin number unit of the coin package is also displayed on the packaged coin number display 125.

This coin type specification is used as the basis for the control unit 132 to read the coin information for that coin type from the storage unit 137. After the set position return command has been given to each adjustment portion and each adjustment portion is returned to a set position, the motors of each adjustment portion are rotated by the calculated number of pulses and rotation amounts so that each adjustment portion is automatically adjusted. Moreover, the number of pulses of the pulse motor $M_3$ which are necessary to adjust the inner diameter of the coin stacking portion 7 so that it is slightly larger than the coin diameter, the amount of rotation of the DC motor $M_2$ which is necessary to adjust the passage height of the coin passage 6 to a height suitable for that thickness, and the number of pulses of the pulse motor $M_1$ which are necessary to adjust the passage width of the coin passage 6 so that it is slightly larger than the diameter of the coin type are respectively calculated and stored in the storage portion 137 when there is an input of the diameter and the thickness.

The following is a description of the adjustment operation.

In the passage width adjustment portion 141, the stepless cam 25 rotates in accordance with the rotation of the pulse motor $M_1$, and rotates clockwise through a required angle from the set position shown in FIG. 2 and presses the cam follower 23. The guide action of the guide rollers 22 and the long holes 21 move the moving passage member 17 to the right as seen in FIG. 2 and stops it at a required gap with respect to the fixed passage member 16. By this, there is adjustment to the passage width corresponding to the diameter of the coin of the set coin type. Accordingly, the stepless cam 25 has a peripheral surface for which the diameter changes without steps, and so it is possible to adjust the width of the passage to one pitch of a rotation angle due to one pulse of the pulse motor $M_1$ for effectively stepless adjustment, and the passage width is able to correspond to coins of any diameter as long as the diameter is within the range of the maximum passage width and the minimum passage width.

When there is movement of the moving passage member 17 to the right, the pin 28, which is the support point for the auxiliary passage member 27, also moves, and accordingly the passage surface 27*a* forms an increasingly smaller angle with respect to the edge portion 17*b* of the moving passage member 17 and approaches a straight line. In addition, the movement of the moving passage member 17 causes the passage exit bottom plate 18 to rotate clockwise and displace about the pivot 31 and via the long hole 34 and the pine 32, and the auxiliary passage member 35 and the sensors $S_2$ and $S_3$ to be positioned parallel to the passage surface 27*a* of the auxiliary passage member 27. Accordingly, as the coin passage width becomes smaller, the passage formed by the auxiliary passage member 27 and the auxiliary passage member 35 approaches a straight line and the end projects to approach the coin stacking portion 7, whereby there is no change in the state of insertion of coins to the coin stacking portion 7 irrespective of the coin diameter.

On the other hand, the passage height adjustment unit 142 has the stepless cam 67 rotated through a required amount of rotation by the rotation of the DC motor $M_2$ and presses down the cam follower 69 so that the moving frame 48 is lowered to oppose the urging of the spring 62 and so that the height of the position of the lower surface of the conveyor belt 43 is adjusted to a position where it presses against the upper surface of the coins of the set coin type. The thickness regulating member 41 is also adjusted to a position of height where only a single coin thickness can pass under its lower surface.

In the coin stacking portion inner diameter adjustment portion 143, the rotation of the pulse motor $M_3$ rotates the stepless cam 92 from the position shown in FIG. 8 and clockwise through a required angle corresponding to the number of pulses. Accompanying this, the cam follower 91 is pressed by the cam surface and gradually moves in a direction away from the center of the cam 92, while the first link 83 rotates clockwise around the pivot 82*a* and the block 71 linked to one end is moved to the left in the figure. Accompanying this movement, the second link 86 rotates in the anticlockwise direction about the pivot 84 and via the third link 88, and the block 72 on the other side moves to the right. By this the gap between the opposing surfaces of the left and right belts 77 and 78 is widened and set to a gap suitable for the outer diameter of the coins of the set coin type. The rotation of the links 83 and 86 moves the blocks 71 and 72 slightly downwards, that is, in the direction of separation from the distal end of the coin passage 6, so that the distance therebetween becomes greater for the larger diameter coins and a position suited to the insertion of the coins is taken.

Furthermore, the rotation of the first link 83 displaces the lever 94 in the clockwise direction about the pivot 84 and via the link 95, and the closing member 93 at its distal end retreats to take a position suited to the increase in the gap between the belts 77 and 78. By these actions, the inner diameter of the coin stacking cavity formed by the belts 77 and 78, the closing member 93 and the guides 99 and 100 is steplessly adjusted to a size suited to the outer diameter of the coins of the set coin type.

In the drive system for the coin stacking portion 7, the arms 105 and 106 are linked by the pivots 109 and 110 to the member 12 and accompany movement of the belts 77 and 78 to the left and right, displacing to become straighter and follow the widening of the space between the belts 77 and 78. The gears 107 and 108 are in a state of constant meshing, and so the drive force of the motor $M_4$ is transmitted to the pulleys 74 and 75 of the belts 77 and 78 via the gears 113, 103, 107, 108 and 104 irrespective of changes in the gap between the left and right belts 77 and 78.

By this action, the passage width and passage height of the coin passage 6 and the inner diameter of the coin stacking portion 7 are all set to values suited to the coin diameter and coin thickness of the coin type to be processed.

The following is a description of the operation from the feeding of coins until their stacking.

When the coni type is set and the start button 128 is pressed, the rotating plate 4 is driven and the coins inserted from the coin insertion hopper 3 are supplied onto the rotating plate 5. At this time, the status of the coins on the rotating plate 5 is monitored by the level sensor $S_4$ and the supply status is controlled.

The rotation of the rotating plate 5 causes the coins on the rotating plate 5 to pass from the periphery to enter beneath the lower surface of the thickness regulating member 41 so that stacked coins are eliminated and a single layer is made, and this single layer then flows into the coin passage 6 where it is pressed by the lower surface of the conveyor belt 43 on the passage inlet bottom plate 15. The rotation of the conveyor belt 43 conveys the coins in a state where they are between the fixed passage member 16 of the coin passage 6 and the edge portions 16*b* and 17*b* of the moving passage member 17. Small-diameter coins smaller than the gap between these edge portions drop from the small-diameter coin exclusion hole 19 between the edges and are excluded.

Coins which have reached the end of the coin passage 6 are counted by the count sensor $S_2$ and their passage is confirmed by the sensor $S_3$, are guided by the rollers 40 and enter inside the coin stacking portion 7.

In this coin stacking portion 7, the support portions 79 and 80 of the left and right belts 77 and 78 are positioned close to the upper end, the coins are held by these support portions 79 and 80 and after there is one coin held, the signals from the sensor $S_3$ are used as the basis for rotating the pulse motor $M_4$ through a required number of pulses corresponding to the thickness of the coins, rotating the belts 77 and 78 so that the support portions 79 and 80 are lowered.

When the number of coins equal to the packaging coin number unit has been counted by the count sensor $S_2$, those signals cause current to pass through a solenoid (not shown) of the stopper 36, when then protrudes into the coin passage 6 and stops the passage of further coins.

The stacked coins of the required number and which have entered the coin stacking portion 7 are received by a support means (not shown in the figure) by the coin support potions 79 and 80 moving from the lower end to the outside, and are left at the packaging portion 10, where they are packaged by packaging paper 8. The packaged coin roll is discharged from the outlet 11.

Figure 16:
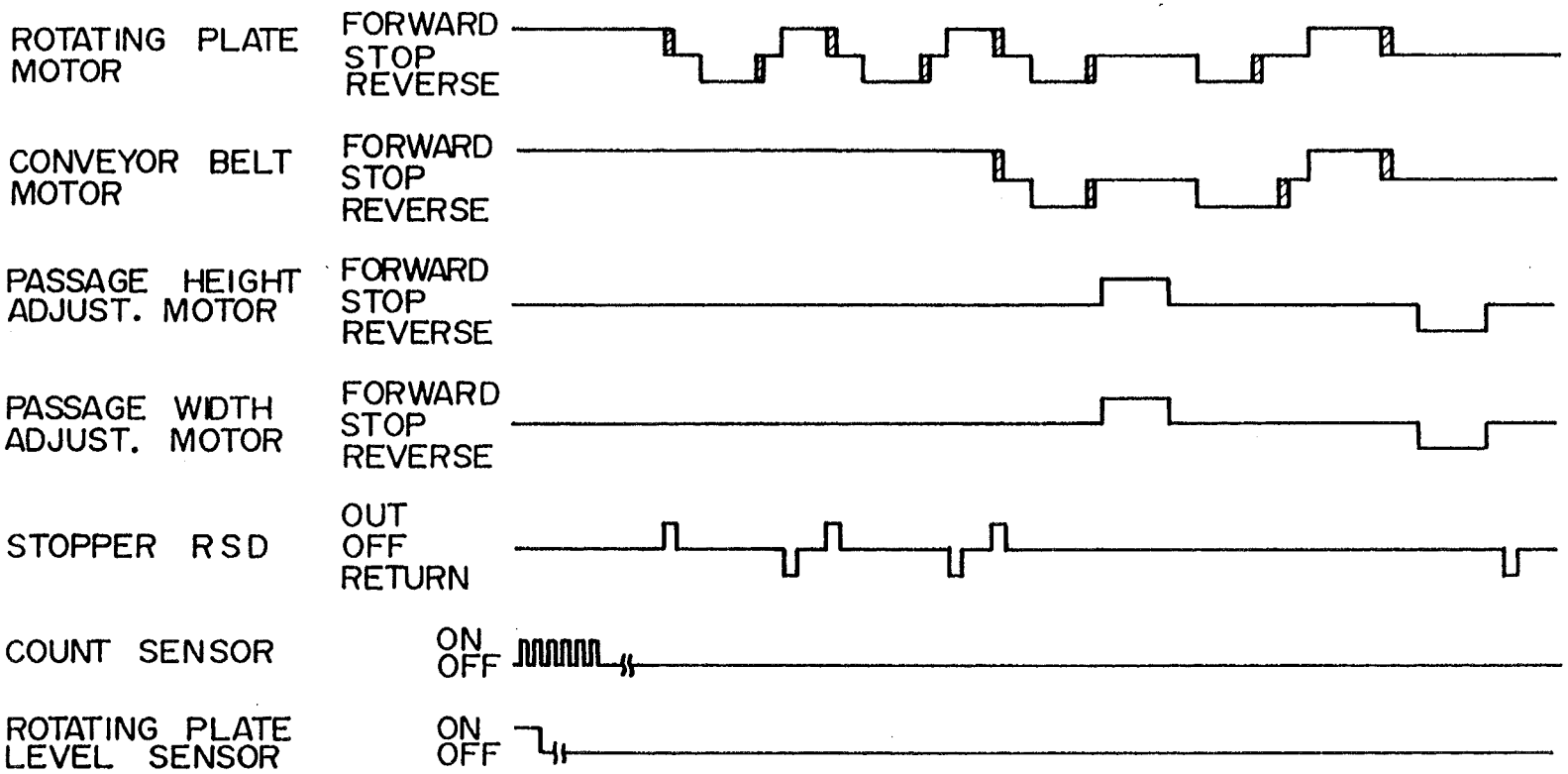
FIG. 16 is a timing chart showing an incorrect coin automatic exclusion operation.

The following is a description of an example of the control status for an abnormal coin automatic exclusion operation with reference to the timing chart shown in FIG. 16. However, in this figure, the portion shown by hatching indicates a brake operation for the motor, and when a solenoid RSD is "OFF" the stopper 36 is held in the status prior to the "OFF" status. If the coins from the rotating plate 5 are not fed into the coin passage 6, the count sensor $S_2$ does not count for a required time, and the OFF status continues, and the lever sensor $S_4$ of the rotating plate 5 turns off because of the reduction in the amount of coins. Then it is judged that there are no more coins, but to check this the rotating plate 5 rotates backwards and forwards twice. At this time, the solenoid RSD of the stopper 36 is controlled so that the stopper 36 protrudes only when there is reverse rotation of the rotating plate 5. By this operation, it is judged that there are no normal coins remaining on the rotating plate 5 if the counter $S_2$ has not counted, the motor of the conveyor belt 43 is driven backwards at the same time as the reverse rotation of the rotating plate 5 and any abnormal coins which have entered the coins passage 6 are returned onto the rotating plate 5. After this, the coin passage height adjustment DC motor $M_2$ and the coin passage width adjustment pulse motor $M_1$ are operated so that the passage width of the coin passage 6 is enlarged and the passage height made higher (by raising the thickness regulating member 41 and the conveyor belt 43).

After this, the forward and reverse operation of the rotating plate 5 and the conveyor belts feed any abnormal coins which have remained on the rotating plate 5 back to the coin passage 6, where they are removed by the exclusion hole. Next, the passage width and the passage height are returned to their set positions and the coin processing ends automatically. The expansion of the passage width and the increase in the passage height can be made to the maximum values but some values less than the maximum values can be used.

Moreover, the embodiment shown in the figures shows desirable embodiments for the coin passage width adjustment means, the coin passage height adjustment means and the coin stacking portion inner diameter adjustment means, but design changes and modifications can be made to the specific configurations for each portion and still remain within the intended scope of the present invention.

For example, in the present invention, when the coin information is stored in the storage portion 137, an operator arbitrarily selects a coin type block (see FIG. 15) and stores the coin information in that block, but a control portion 132 can select an empty coin type block and store the information in that block.

In addition to the information described above, the storage unit 137 can also store other information such as the power frequency and the like.

Furthermore, other than an EEPROM, the storage unit 137 can be a RAM or the like having a battery backup.

Each of the items of information need not read from the EEPROM when adjustment is made, but all of the information can be read from the EEPROM when the power is turned on or when settings are stored, and stored in a RAM, and each item of information read from the RAM when adjustment is made.

In addition, in the present embodiment the coin passage width information $P_1$, the coin passage height information $P_2$ and the coin collecting portion inner diameter information $P_3$ are calculated when the coin information is input, and are then stored in the storage unit 137, but the information $P_1$, $P_2$ and $P_3$ can be calculated when adjustments are made. In addition, the coin information which is stored in the storage unit 137 can be stored onto an IC card as backup information.

As has been described above, according to the present invention, the passage width and passage height of a coin passage which conveys coins, and the inner diameter of a stacking portion, can be steplessly adjusted in accordance with coin information for the coins to be processed, and the coin information of the coin information storage means can be used as the basis for the automatic adjustment of the passage width and passage height of a coin passage which conveys coins and the inner diameter of a stacking portion, and so it is possible to facilitate the operation of changing the coin type and to process coins of any diameter. In particular, it is possible to provide a coin packaging apparatus even for countries where there are large differences in the diameters of coins, and so use the same coin packaging apparatus for all countries.

What is claimed is:

1. A coin packaging apparatus, comprising:

a circular plate for feeding coins;

a coin passage for receiving coins one by one from said circular plate, totaling the number of coins and separating coins, said coin passage having a passage width and a passage height;

a coin stacking portion for receiving coins from said coin passage and stacking a number of coins, said coin stacking portion defining a space having an inner diameter for receiving and stacking coins;

a coin packaging portion for packaging coins stacked by said coin stacking portions;

a passage width adjustment means for steplessly adjusting the passage width of said coin passage;

a coin passage height adjustment means for steplessly adjusting the passage height of said coin passage;

a coin stacking portion inner diameter adjustment means for steplessly adjusting the inner diameter of said coin stacking portion;

a coin information input means for inputting coin information, including the diameter and thickness of coins to be processed;

a coin information storage means for storing coin information of the diameter and thickness of coins to be processed in correspondence with a type of coin;

a coin type specification means for specifying the type of coin to be processed;

a control unit connected with said coin information input means, said coin information storage means and said coin type specification means which determines the inner diameter of said space of said coin stacking portion and the height and width of said coin passage from coin information from said coin information storage means and the type of coin to be processed specified by said coin type specification means, and which operates each of said adjustment means to set the determined inner diameter of said coin stacking portion and height and width of said coin passage; and a calculation means for calculating the inner diameter of said coin stacking portion and the height and width of said coin passage for the specified type of coin to be processed from the coin information, wherein said control unit operates each of said adjustment means based on specifications from said coin type specification means such that the specifications are in agreement with the calculation results of said calculation means.

2. The coin packaging apparatus of claim 1, and further comprising a fine adjustment means for finely adjusting the inner diameter of said coin stacking portion and the height and width of said coin passage for a specified coin type by direct input of the inner diameter of said coin stacking portion and the height and width of said coin passage for the specified coin type.

3. A coin packaging apparatus, comprising:

a coin feeding device comprising a rotatable circular plate;

a coin stacking device comprising coin receiving and stacking portions defining an adjustable coin receiving and stacking space therebetween, said coin receiving and stacking portions being spaced-apart with a spacing therebetween;

a coin receiving and delivering device between said coin feeding device and said coin stacking device, said coin receiving and delivering device defining a coin passage for receiving coins one by one from said circular plate, totaling the number of coins, separating coins, and delivering coins to said coin stacking device, said coin passage having an adjustable passage width and an adjustable passage height;

a coin packaging portion adapted to package coins stacked by said coin stacking portion;

a passage width adjustment mechanism adapted to steplessly adjust the width of said coin passage;

a passage height adjustment mechanism adapted to steplessly adjust the passage height of said coin passage;

a coin receiving and stacking portions adjustment mechanism adapted to steplessly adjust the spacing between said coin receiving and stacking portions;

a coin information input unit adapted for the input of coin information including the diameter and thickness of coins to be processed;

a coin information storage unit adapted to store coin information of the diameter and thickness of coins to be processed in correspondence with a type of coin;

a coin type specification unit adapted to specify the type of coin to be processed;

a control unit connected with said coin information input unit, said coin information storage unit and said coin type specification unit adapted to determine the spacing between said coin receiving and stacking portions of said coin stacking device and the height and width of said coin passage from coin information from said coin information storage unit and the type of coin to be processed specified by said coin type specification unit, and to operate each of said adjustment mechanisms to set the determined spacing between said coin receiving and stacking portions of said coin stacking device and the height and width of said coin passage; and a calculation means for calculating the spacing between said coin receiving and stacking portions and the height and width of said coin passage for the specified type of coin to be processed from the coin information, wherein said control unit operates each of said adjustment mechanisms based on specifications from said coin type specification unit and such that the specifications are in agreement with the calculation results of said calculation means.

4. The coin packaging apparatus of claim 3, and further comprising a fine adjustment means for finely adjusting the spacing between said coin receiving and stacking portions and the height and width of said coin passage for a specified coin type by direct input of the spacing between said coin receiving and stacking portions and the height and width of said coin passage for the specified coin type.

5. The coin packaging unit of claim 3, wherein said control unit is operatively connected to each of said adjustment mechanisms, each of said adjustment mechanisms comprising a motor controlled by said control unit and a position detector sensor.

* * * * *